US005599069A

United States Patent [19]

Lorbiecki

[11] Patent Number: 5,599,069

[45] Date of Patent: Feb. 4, 1997

[54] FLEXIBLE UNITARY SEAT SHELL INCLUDING BASE SECTION HAVING FRAME SOCKETS

[75] Inventor: James R. Lorbiecki, Milwaukee, Wis.

[73] Assignee: Milsco Manufacturing Company, Milwaukee, Wis.

[21] Appl. No.: 629,277

[22] Filed: Apr. 8, 1996

Related U.S. Application Data

[62] Division of Ser. No. 339,004, Nov. 14, 1994, Pat. No. 5,538,326.

[51] Int. Cl.[6] ..... A47C 7/02

[52] U.S. Cl. ..... 297/452.15; 297/440.2; 297/440.22; 297/DIG. 2

[58] Field of Search ..... 297/DIG. 2, 452.12, 297/452.14, 452.15, 452.33, 452.34, 284.9, 452.36, 468, 485, 463.1, 484, 452.55, 440.13, 440.1, 301.1, 440.22, 354.1, 440.2

[56] References Cited

U.S. PATENT DOCUMENTS

| | | | |
|---|---|---|---|
| D. 308,605 | 9/1990 | Uecker et al. . | |
| D. 342,850 | 1/1994 | Slicker et al. . | |
| 3,054,643 | 9/1962 | Militano | 297/440.2 |
| 3,612,606 | 10/1971 | Swenson . | |
| 3,663,057 | 5/1972 | Lohr et al. . | |
| 3,740,014 | 6/1973 | Swenson et al. . | |
| 3,751,109 | 8/1973 | Dufton | 297/451.11 X |
| 3,758,159 | 9/1973 | Morris | 297/452.14 |
| 3,957,304 | 5/1976 | Koutsky et al. | 297/468 |
| 4,002,369 | 1/1977 | Jennings . | |
| 4,181,357 | 1/1980 | Swenson et al. . | |
| 4,191,113 | 3/1980 | Hogberg | 297/440.1 X |
| 4,333,683 | 6/1982 | Ambasz | 297/301.1 X |
| 4,344,597 | 8/1982 | Eimen . | |
| 4,544,205 | 10/1985 | Molnar . | |
| 4,561,621 | 12/1985 | Hill . | |
| 4,577,907 | 3/1986 | Talmon et al. | 297/452.14 X |
| 4,593,950 | 6/1986 | Infanti | 297/440.13 X |
| 4,647,109 | 3/1987 | Christophersen et al. . | |
| 4,662,597 | 5/1987 | Uecker et al. . | |
| 4,687,250 | 8/1987 | Esche . | |
| 4,709,961 | 12/1987 | Hill . | |
| 4,709,963 | 12/1987 | Uecker et al. . | |
| 4,836,609 | 6/1989 | Hill . | |
| 4,838,514 | 6/1989 | Hill . | |
| 4,892,356 | 1/1990 | Pittman et al. . | |
| 5,127,621 | 7/1992 | Uecker et al. . | |
| 5,176,356 | 1/1993 | Lorbicki et al. . | |
| 5,183,314 | 2/1993 | Lorbiecki . | |
| 5,221,071 | 6/1993 | Hill . | |
| 5,275,467 | 1/1994 | Kawecki | 297/440.13 |
| 5,340,197 | 8/1994 | Vogtherr | 297/452.12 |
| 5,344,215 | 9/1994 | Dahlbacka . | |

FOREIGN PATENT DOCUMENTS

| | | | |
|---|---|---|---|
| 3536206 | 4/1987 | Germany | 297/250.1 |
| 7804978 | 11/1978 | Netherlands | 297/300.2 |

*Primary Examiner*—Milton Nelson, Jr.
*Attorney, Agent, or Firm*—Nilles & Nilles, S.C.

[57] ABSTRACT

A flexible unitary seat shell is disclosed to include: a base section defining a base section plane, the base section including two frame sockets for engaging, along axes that are substantially parallel to the base section plane, projections on a seat frame, each of the two frame sockets protruding from a back of said base section and including an encircling aperture that defines a plane that is nonparallel to the base section plane; a back section in angular relationship to the base section; and an intermediate section connecting the base section to the back section, the intermediate section forming a hinge between the base section and the back section to permit changes in the angular relationship between the base section and the back section.

18 Claims, 8 Drawing Sheets

FLEXIBLE UNITARY SEAT SHELL INCLUDING BASE SECTION HAVING FRAME SOCKETS

This application is a division, of application Ser. No. 08/339,004 filed Nov. 14, 1994 and now U.S. Pat. No. 5,538,326.

BACKGROUND OF THE INVENTION

1. Field of Use

The present invention relates generally to the field of seating. More particularly, the present invention concerns seat shells that are of unitary construction. Specifically, a preferred embodiment of the present invention is directed to a unitary seat shell that includes a flexible section. The present invention thus relates to seat shells of the type that can be termed flexible unitary seat shells.

2. Description of Related Art

Within this application several publications are referenced by arabic numerals within parentheses. Full citations for these publications my be found at the end of the specification immediately preceding the claims. The disclosures of all these publications in their entireties are hereby expressly incorporated by reference into the present application.

Heretofore, it was known in the prior art to provide a seat having a separate back and base. A conventional seat is typically assembled from a back cushion, a base cushion and a frame. For example, a conventional seat can be assembled by bolting two separate cushions to a tubular steel frame.

A previously recognized problem has been that the time required for assembly of such a seat is lengthy. What is needed therefore is way of assembling the cushions to the frame that requires less time.

Another previously recognized problem has been that numerous fasteners are required for assembling such a seat. What is also needed therefore is way of assembly that requires fewer fasteners. Heretofore these requirements have not been fully met without incurring various disadvantages.

One unsatisfactory previously recognized solution to the problem of separate back and base was to injection mold a unitary seat shell. By combining the back and base into one unit, the time required for assembly is reduced. A disadvantage of this previously recognized solution is that injection mold tooling is expensive. Further, this previously recognized solution also has the disadvantage that numerous fasteners are still required to attach the seat shell to the frame.

Heretofore, it was known in the prior art to thermoform a sheet of plastic.[1,2] For example, a conventional thermoplastic is typically thermoform with a vacuum thermoform mold. Thermoforming is limited to fabricating shapes of limited relief. If the amount of relief is too high, impermissible thinning of the thermoplastic material thickness results in the high relief sections of the mold. Further, if the amount of relief is too high, the decorative embossment of the thermoplastic is disrupted in the high relief sections of the mold. For example, a rigid unitary seat shell is a high relief design because of the angular junction between the back of the seat and the base of the seat. In the case of a high relief shape such as a unitary seat shell, thermoforming the finished shape would result in an impermissibly thin edge at the junction of the back section and the base section because of the amount of draw required to form the angular junction between the back of the seat and the base of the seat.

Moreover, the decorative embossment of the thermoplastic material would be unattractively disrupted at both the top of the back and at the front of the base because of the amount of draw required to form the angular junction.

The below-referenced prior patents disclose embodiments that were at least in-part satisfactory for the purposes for which they were intended but which had disadvantages. The disclosures of all the below-referenced prior patents in their entireties are hereby expressly incorporated by reference into the present application.

U.S. Pat. No. 5,344,215 discloses a backrest recliner mechanism. U.S. Pat. No. 5,221,071, discloses a vehicle seat suspension. U.S. Pat. No. 5,183,314 discloses a concealed mechanism for detachably mounting a vehicle seat. U.S. Pat. No. 5,176,356, discloses a suspension for a two piece seat shell assembly. U.S. Pat. No. 5,127,621 discloses a pivotable seat assembly with latch mechanism. U.S. Pat. No. 4,838,514, discloses a vehicle seat. U.S. Pat. No. 4,836,609 discloses a unitary shell for a vehicle seat. U.S. Pat. No. 4,709,963 discloses an adjustable office chair. U.S. Pat. No. 4,709,961 discloses a self-releasing ratchet seat adjustment. U.S. Pat. No. 4,687,250 discloses an adjustable seat assembly for vehicles. U.S. Pat. No. 4,662,597 discloses a suspension for a vehicle seat. U.S. Pat. No. 4,647,109 discloses a upholstered seat assembly and a one-piece seat and back shell of molded plastic. U.S. Pat. No. 4,561,621 discloses a tiltable vehicle seat. U.S. Pat. No. 4,344,597 discloses a vehicle seat with fore-and-aft shock isolation. U.S. Pat. No. 4;481,357 discloses a seat backrest tilt and height adjustment. U.S. Pat. No. 3,740,0.14 discloses an adjustable seat assembly for a vehicle. U.S. Pat. No. 3,612,606 discloses a seat having foldable armrests. U.S. Pat. No. Design 342,850 discloses an ornamental design for a seat. U.S. Pat. No. Design 308,605 discloses an ornamental design for a chair.

In embodiments disclosed in the above-referenced prior patents without unitary seat shells, the back and base cushions of the seam are disclosed as being separately connected to the underlying frame. Such a non-unitary approach has the disadvantage that assembly costs are increased due to an increase in the number of fasteners, as well as a lengthy assembly time. Those embodiments disclosed in the above-reference prior patent having unitary seat shells have the disadvantage that expensive tooling is required to injection mold the seat shells. Further, separate assembly fasteners are still required to attach the unitary seat shells to the underlying frames.

SUMMARY OF THE INVENTION

It is therefore an object of the present invention to provide a flexible unitary seat shell comprising: a base section; a back section in angular relationship to the base section; and an intermediate section connecting the base section to the back section, the intermediate section forming a hinge between the base section and the back section to permit changes in the angular relationship between the base section and the back section.

In accordance with this aspect of the present invention, a flexible unitary seat shell is provided comprising: an intermediate section including A) an elongated flexible section defining an axis of deflection, said elongated flexible section including a fast flexible section edge substantially parallel to said axis of deflection and a second flexible section edge substantially parallel to said axis of deflection and B) an elongated resilient section connected to said elongated flexible section, said elongated resilient section a) defining a resilient section axis that is substantially parallel to said axis of deflection and b) including 1) a first resilient edge that is substantially parallel with said resilient section axis and is continuously connected to said first flexible section edge of said elongated flexible section, 2) a second resilient edge that is substantially parallel to said resilient section axis, 3) a fast side that is substantially perpendicular to said resilient section axis and 4) a second side that is substantially perpendicular to said resilient section axis; a base section connected to said elongated resilient section, said base section a) defining a base section plane that is substantially parallel to said resilient section axis and b) including an edge that is substantially parallel to said base section plane and is continuously connected to said second resilient edge of said elongated resilient section; and a back section connected to said elongated flexible section, said back section a) defining a back section plane that is substantially parallel to said axis of deflection and b) including an edge that is substantially parallel to said back section plane and is continuously connected to said second flexible section edge of said elongated flexible section, wherein said back section plane can be elastically deformed with regard to said base section plane around said axis of deflection through an angle of at least approximately 60 degrees.

Further in accordance with the above aspects of the present invention, a method of making a flexible unitary seat shell is provided comprising: providing a vacuum thermoforming mold; providing a sheet of thermoplastic material having a first side, a second side, a set temperature and a melting temperature; heating the sheet of thermoplastic material to a working temperature less than the melting temperature and higher than the set temperature; placing first side of the sheet adjacent the vacuum thermoforming mold; forming the thermoplastic material by applying a vacuum to the thermoplastic material through the vacuum thermoforming mold so as to mold the thermoplastic material; allowing the thermoplastic material to cool below the set temperature; removing the thermoplastic material from the vacuum thermoforming mold; placing a first trim template adjacent the first side of the thermoplastic material; removing a first portion of the thermoplastic material; placing a second trim template adjacent the second side of the thermoplastic material; and removing a second portion of the thermoplastic material.

Other aspects and objects of the present invention will be more appreciated and understood when considered in conjunction with the following description and drawings.

BRIEF DESCRIPTION OF THE DRAWINGS

The advantages and features of the present invention will become more readily apparent with reference to the detailed description which follows and to exemplary, and therefore non-limiting, embodiments illustrated in the following drawings in which like reference numerals refer to like elements and in which.

DESCRIPTION OF THE PREFERRED EMBODIMENTS

Figure 1:
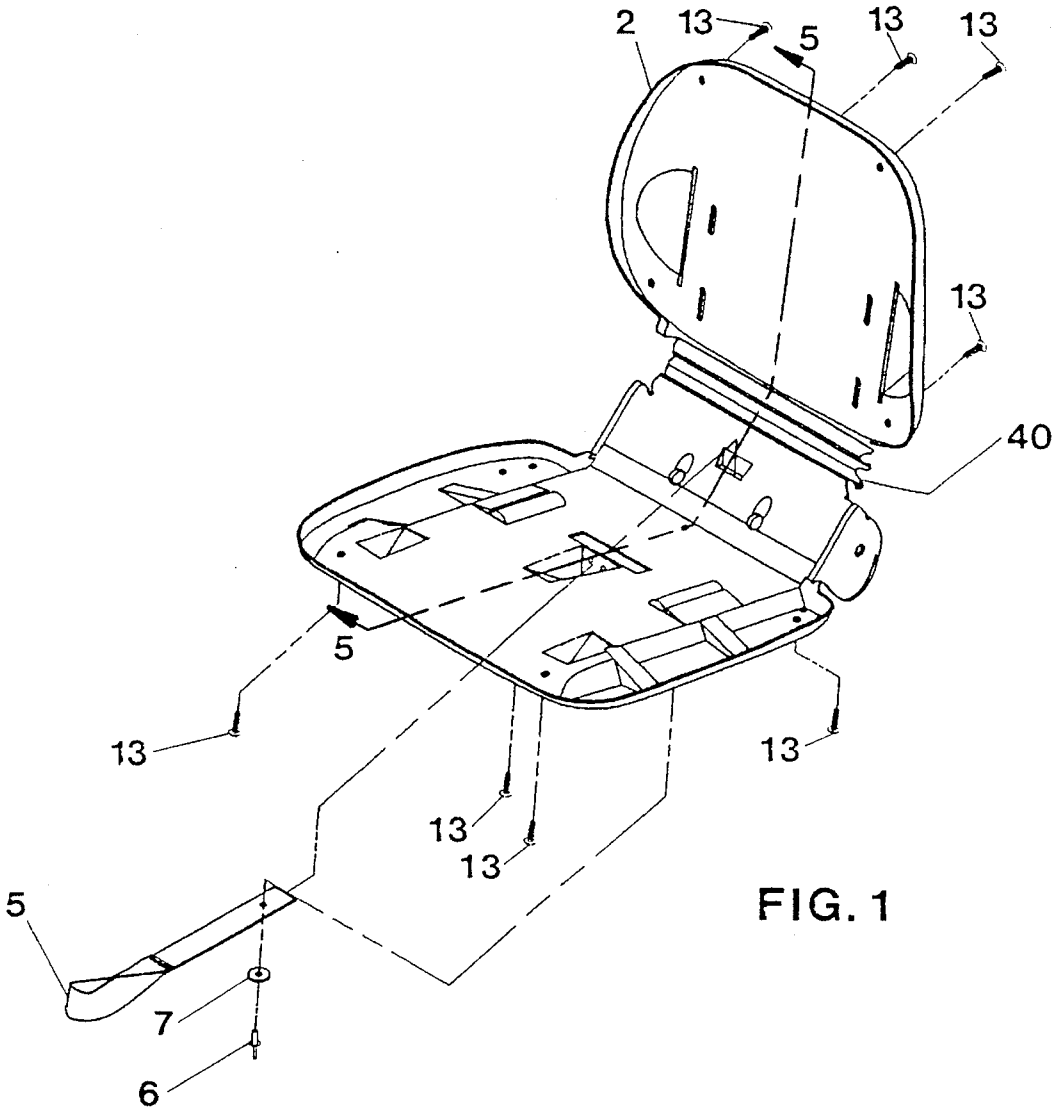
FIG. 1 illustrates an isometric view of a flexible unitary seat shell according to the present invention.

The present invention and various aspects, objects, advantages, features and advantageous details thereof are explained more fully below with reference to exemplary, and therefore non-limiting, embodiments described in detail in the following disclosure and with the aid of the drawings. In each of the drawings, parts the same as, similar to, or equivalent to each other, are referenced correspondingly.

1. Resume

All the disclosed embodiments can be realized using conventional materials, components and procedures without undue experimentation. All the disclosed embodiments are useful in conjunction with the fabrication of vehicle seats such as are used as driver's or operator's seats on vehicles such as farm tractors, construction machines, or the like.

2. System Overview

Referring to the drawings, it can be seen that the present invention includes a back and a base connected with a hinge. Pursuant to the present invention, the hinge provides the flexibility of the unitary seat shell.

By thermoforming the unitary seat shell with an intermediate section that functions as a hinge, several advantages are obtained. By forming the shell in one configuration and then deflecting the back section and base section with regard to the angular relationship therebetween, the previously recognized problems of impermissible thinning and decorative embossment disruption in high relief areas of the design are solved since the shell is formed in a relatively flat, relatively low relief, configuration. The relatively low relief of the forming mold results in much better uniformity of thickness across the entire area and along the full perimeter of the shell. Further, there is much less disruption of the decorative embossment of the thermoplastic material. Since the relief of the forming mold is relatively low, the design of the mold can incorporate various features such as snap-fit protrusions, frame sockets and lateral deflection protrusions. The ability of the mold to incorporate such features increases the design flexibility. In a preferred embodiment, fastening structures can be integrally formed into the shell itself, thereby further reducing the number of fasteners required to attach the shell to the frame of a seat. In an especially preferred embodiment, no fasteners are required to attach the shell to the frame of a seat. Moreover, no expensive injection mold tooling is required to fabricate the shell because it is thermoformed as a sheet.

3. Detailed Description

Referring to FIG. 1, an isometric view of a flexible unitary seat shell 2, according to the present invention is illustrated where the flexible unitary seat shell 2, is configured in an upright position approximating a right angle. The flexible unitary seat shell 2, is preferably elastically deformed at least 60 degrees from the position in which the flexible unitary seat shell 2, was formed when in a state of final assembly for use. Still referring to FIG. 1, the illustrated configuration is an elastic deformation of approximately 90 degrees from the as formed configuration. Advantageously, the flexible unitary seat shell 2, should be capable of being elastically deformed at least approximately 120 degrees, more advantageously at least approximately 150 degrees, or even more advantageously at least approximately 180 degrees from the thermoformed configuration so as to provide reserve flexibility. Strap 5, can be attached to the flexible unitary seat shell 2, with rivet 6, and washer 7. Screws 13, can be inserted through the flexible unitary seat shell 2, so as to attach cushions, not shown in FIG. 1.

Figure 2:
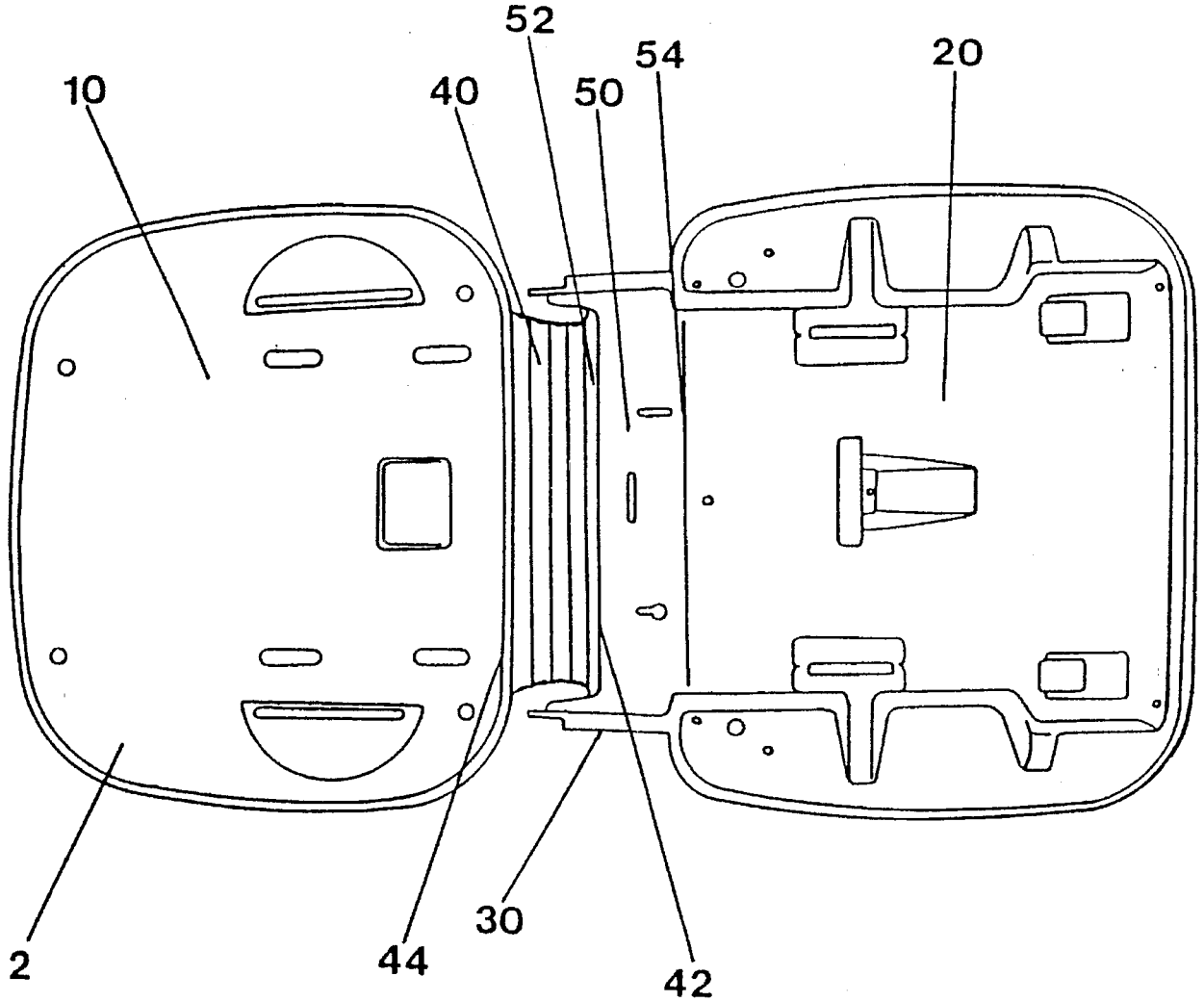
FIG. 2 illustrates a plan view of a first side of a flexible unitary seat shell according to the present invention.

Referring now to FIG. 2, a plan view of a first side of a flexible unitary seat shell 2, according to the present is illustrated where a back section 10, and a base section 20, are clearly visible. The back section 10, is connected to base section 20, through an intermediate section 30, forming a hinge between base section 20, and the back section 10, to permit elastic changes in the angular relationship therebetween of at least 60 degrees. In a preferred embodiment, intermediate section 30, includes an elongated flexible section 40, defining a hinge or an axis of deflection. In a preferred embodiment, the flexible section 40, is formed as an accordion pleat that includes a series of parallel grooves. The elongated flexible section 40, includes a fast flexible section edge 42, substantially parallel to said axis of deflection and a second flexible section edge 44, substantially parallel to said axis of deflection. In a preferred embodiment, intermediate section 30, includes an elongated resilient section 50, connected to the elongated flexible section 40. The elongated resilient section 50, defines a resilient section axis that is substantially parallel to the axis of deflection. The elongated resilient section 50, includes a first resilient edge 52, that is substantially parallel with the resilient section axis and is continuously connected to said fast flexible section edge 42, of said elongated flexible section 40. The elongated resilient section 50, includes a second resilient edge 54, that is substantially parallel to said resilient section axis.

Figure 3:
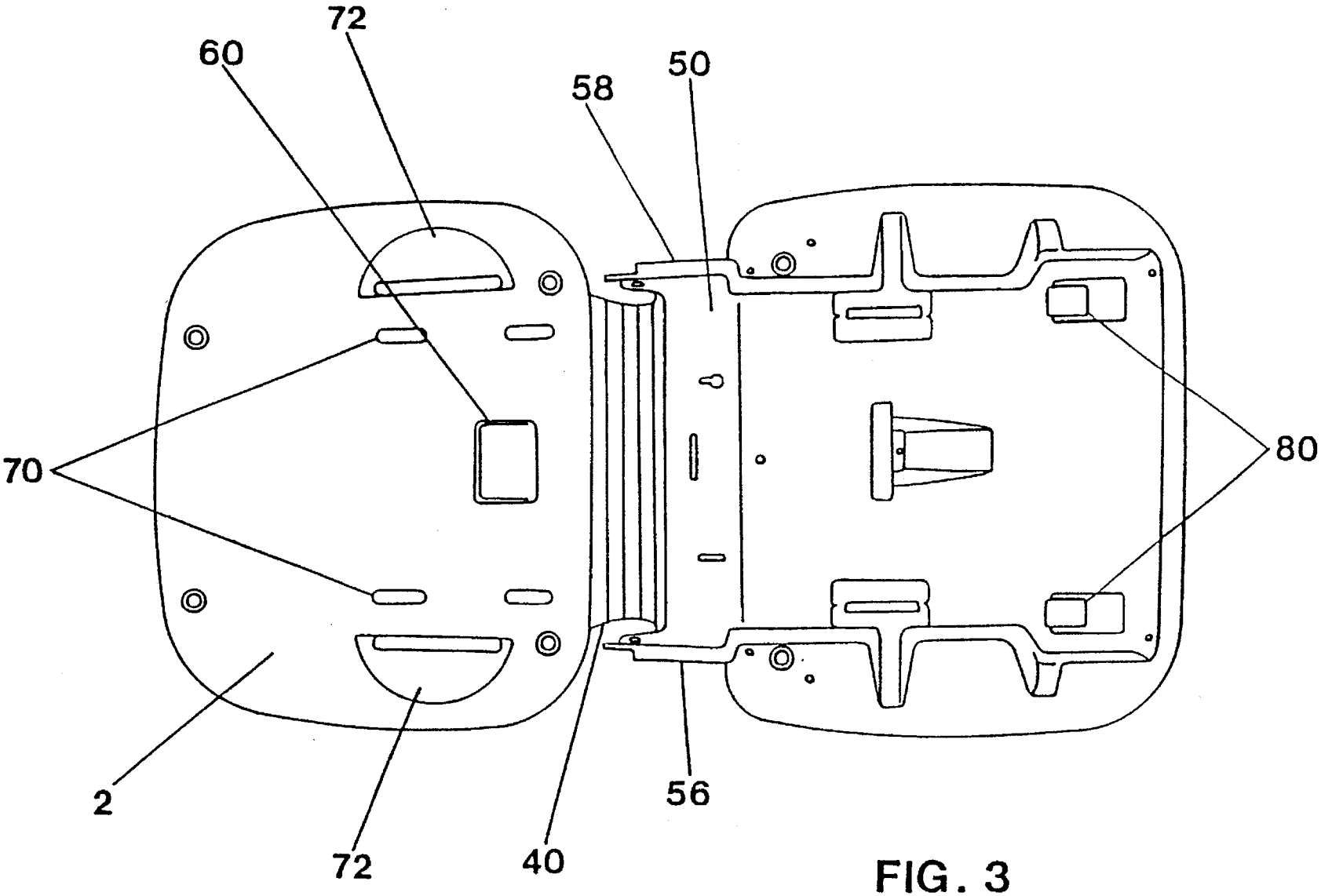
FIG. 3 illustrates a plan view of a second side of the flexible unitary seat shell shown in FIG. 2.

Referring now to FIG. 3, a plan view of a second side of the flexible unitary seat shell 2, as shown in FIG. 2, is illustrated where an outside of the back section 10, and an outside of the base section are clearly visible. The elongated resilient section 50, includes a first side 56, that is substantially perpendicular to said resilient section axis. The elongated resilient section 50, includes a second side 58, that is substantially perpendicular to said resilient section axis.

A snap-fit protrusion 60, is designed to engage a structural member of a frame, not shown in FIG. 3, to which the flexible unitary seat shell 2, will be connected. The snap-fit protrusion 60, is preferably designed to engage a orthogonal bar provided on the frame. Frame slots 70, are similarly designed to engage the frame. Frame slots 70, are preferably designed to engage hooks provided on the frame. The back section 10, is preferably provided with lateral deflection protrusions 72. Frame sockets 80, are similarly designed to engage the frame. Frame sockets 80, are preferably designed to engage tubular projections provided on the frame.

Figure 4:
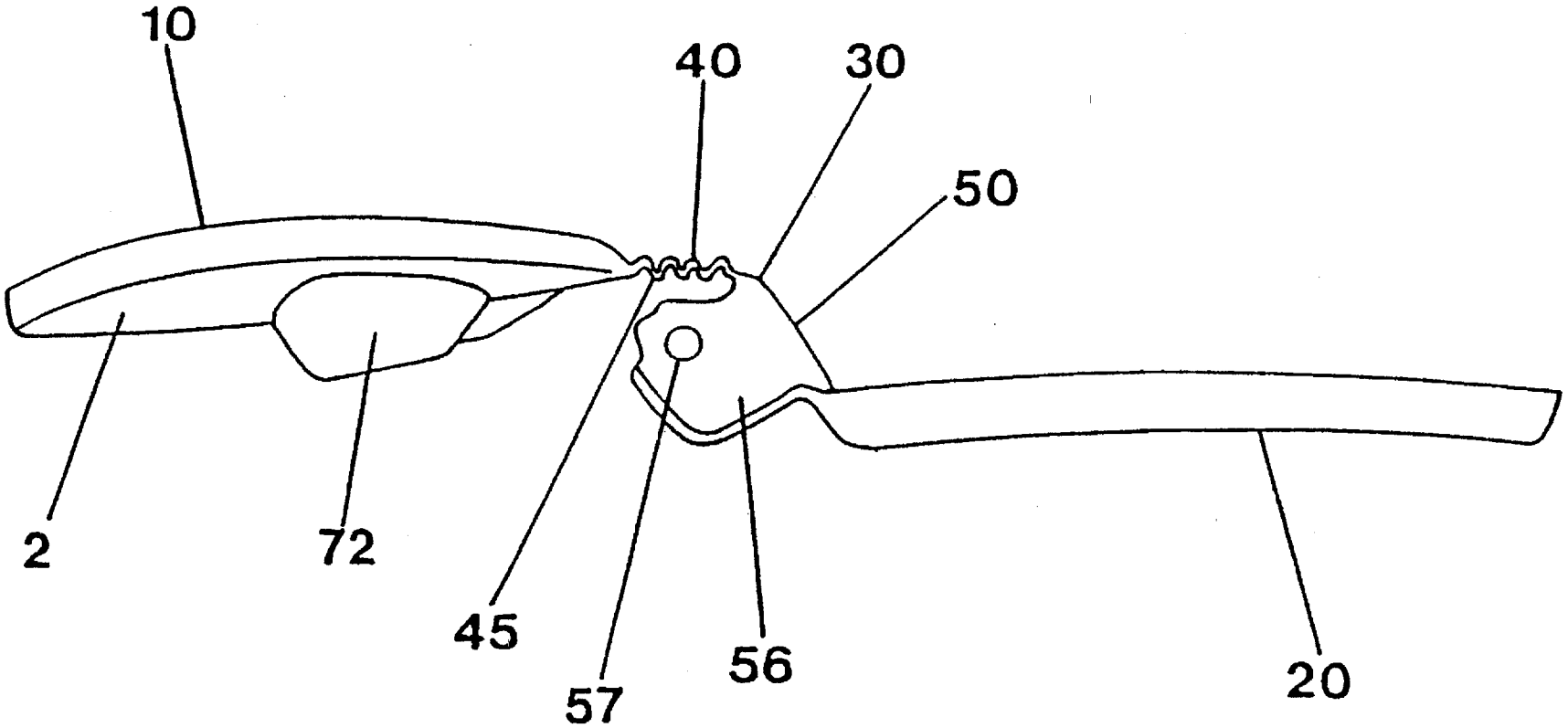
FIG. 4 illustrates an elevation view of the flexible unitary seat shell shown in FIG. 2.

Referring now to FIG. 4, an elevation view of the flexible unitary seat shell 2, as shown in FIG. 2, is illustrated where the intermediate section 30, is clearly visible. As discussed above, the intermediate section 30, includes an elongated flexible section 40, and an elongated resilient section 50. In a preferred embodiment, the elongated flexible section 40, includes an accordion pleated element 45. The accordion pleated section has a substantially sinusoidal cross section taken through the axis of deflection. As discussed above, the elongated resilient section 50, includes a first side 56, that is substantially perpendicular to said resilient section axis and this first side 56, is preferably provided with a seat belt bolt hole 57.

Figure 5:
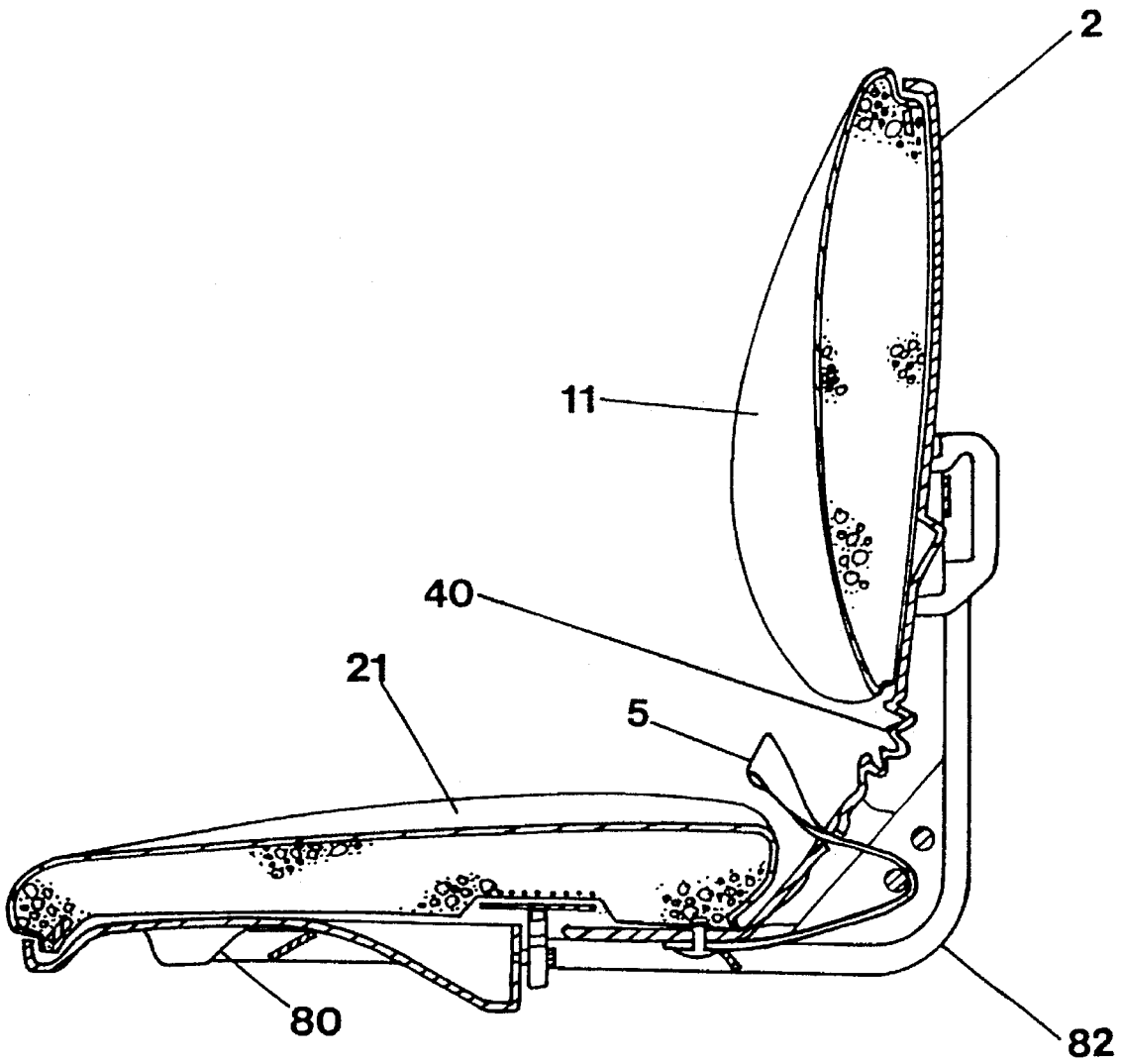
FIG. 5 illustrates a cross sectional view of a seat having a flexible unitary seat shell according to the present invention.

Referring now to FIG. 5, a cross sectional view of a flexible unitary seat shell 2, according to the present invention is illustrated where a back cushion 11, and a base cushion 21, have been attached. The sectional view shown in FIG. 5 is taken along the line 5—5 in FIG. 1, the cushions and frame of the seating assembly not being shown in FIG. 1 for the purpose of clarity. The flexible unitary seat shell is also attached to a framework 82.

Figure 6:
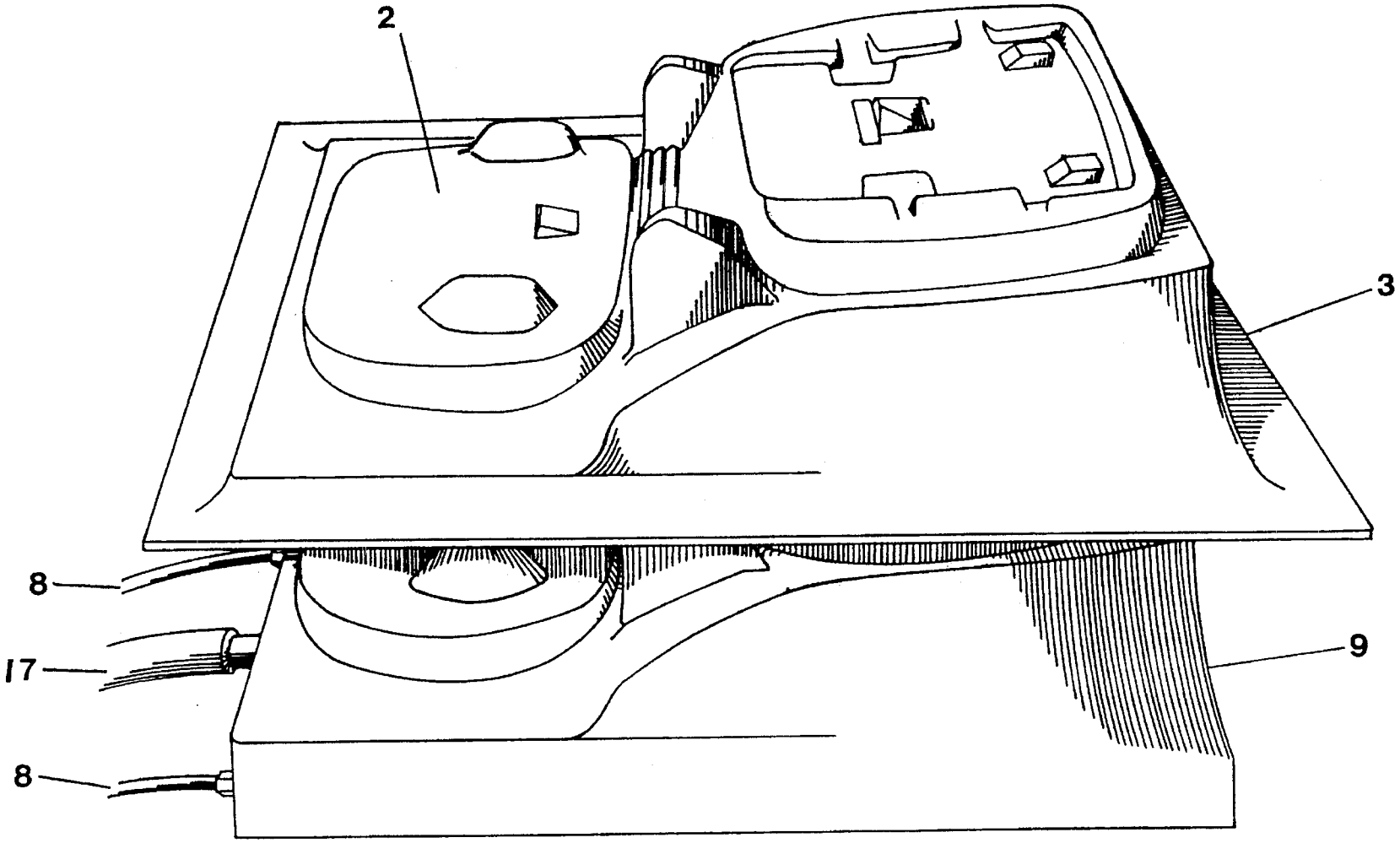
FIG. 6 illustrates an isometric view of a formed flexible unitary seat shell blank raised above a thermoforming mold according to the present invention.

Referring now to FIG. 6, an isometric view of a formed flexible unitary seat shell blank 3, raised above a thermoforming mold 9, according to the present invention is illustrated where the unitary nature of the flexible unitary seat shell 2, is particularly apparent. The thermoforming mold 9, includes a vacuum conduit 17, and liquid coolant lines 8.

Figure 7:
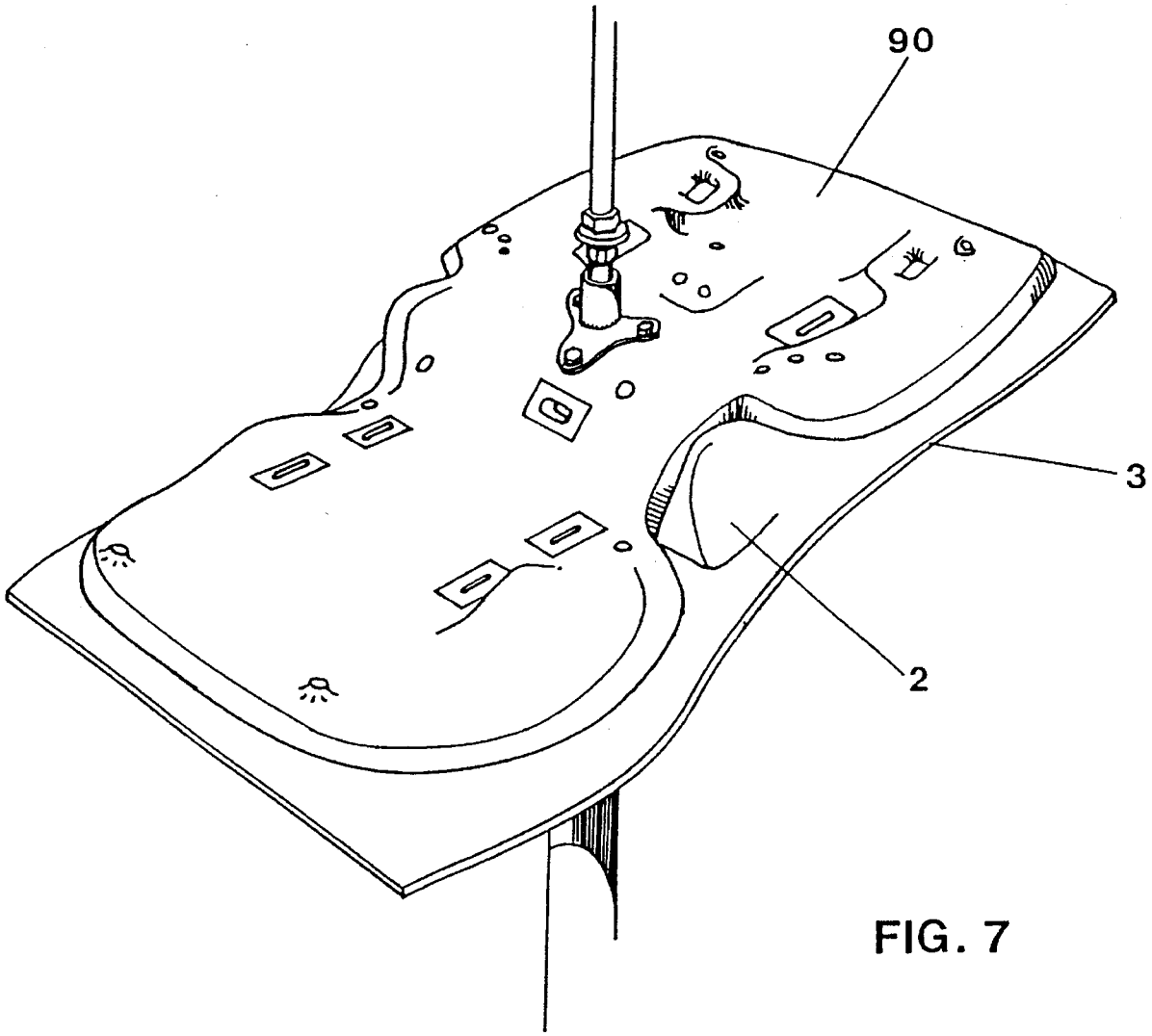
FIG. 7 illustrates an isometric view of a formed flexible unitary seat shell blank adjacent a first trim template according to the present invention.

Referring now to FIG. 7, an isometric view of a formed flexible unitary seat shell blank 3, adjacent a first trim template 90, according to the present invention is illustrated where excess thermoformed material extends beyond the perimeter of the first trim template 90.

Figure 8:
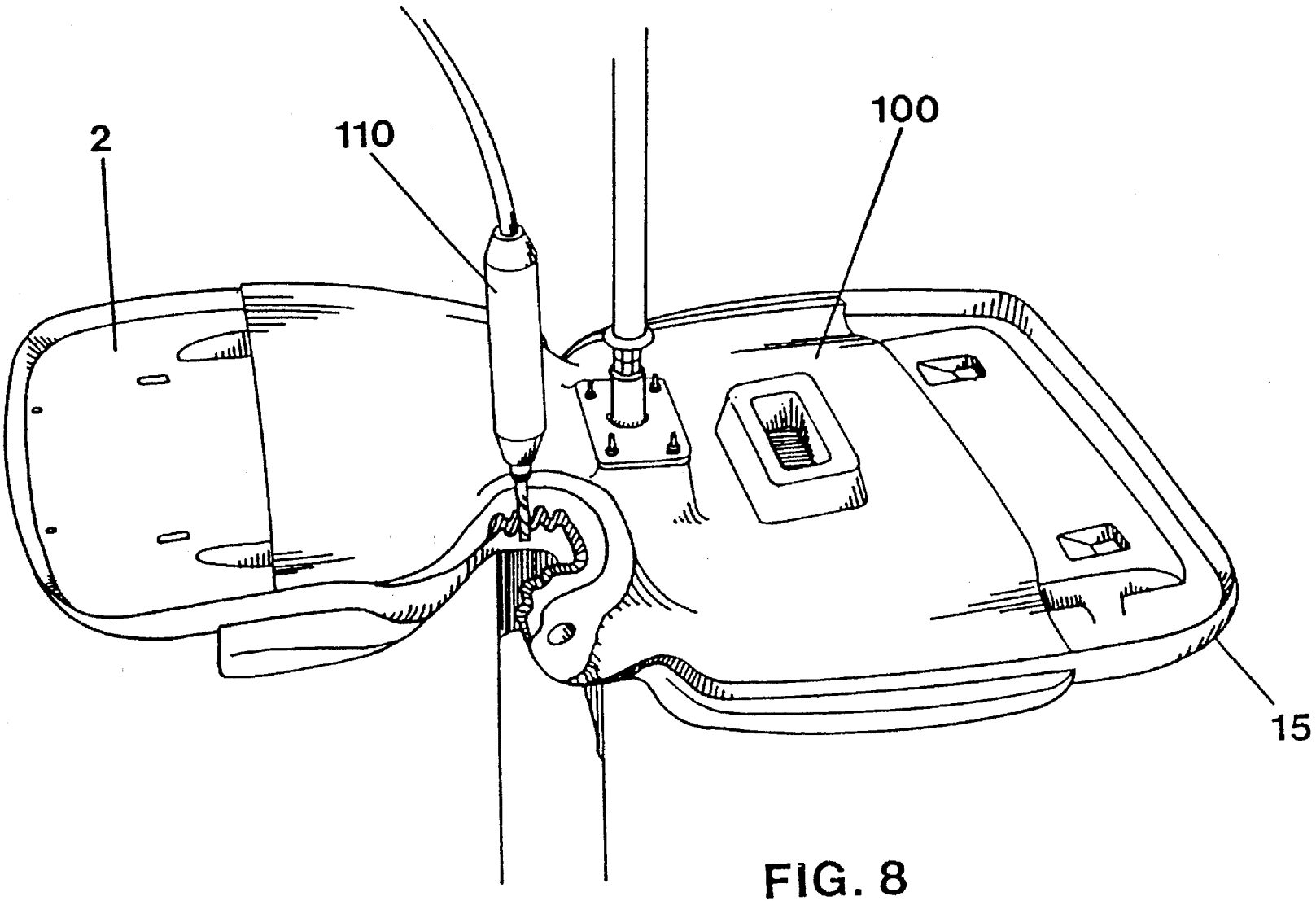
FIG. 8 illustrates an isometric view of a formed, partially trimmed, flexible unitary seat shell blank adjacent a second trim template according to the present invention.

Referring now to FIG. 8, an isometric view of a partially trimmed formed flexible unitary seat shell blank 5, adjacent a second trim template 100, according to the present invention is illustrated. Cutting tool 110, is shown in working engagement with excess thermoformed material of partially trimmed formed flexible unitary seat shell blank 15.

A preferred method of making the flexible unitary seat shell according to the present invention will now be described. A vacuum thermoforming mold is provided. A sheet of thermoplastic material having a first side, a second side, a set temperature and a melting temperature is provided. The sheet of thermoplastic material is heated to a working temperature less than the melting temperature and higher than the set temperature. The first side of the sheet is placed adjacent the vacuum thermoforming mold. The thermoplastic material is formed by applying a vacuum to the thermoplastic material through the vacuum thermoforming mold so as to mold the thermoplastic material. The thermoplastic material is allowed to cool below the set temperature. The formed thermoplastic material is removed from the vacuum thermoforming mold. A first trim template is placed adjacent the first side of the thermoplastic material. A first portion of the thermoplastic material is removed. A second trim template is placed adjacent the second side of the thermoplastic material. A second portion of the thermoplastic material is removed. Of come, additional material can be removed while either or both of the templates are adjacent the thermoplastic material and other cutting operations can be preformed with, or without, one or both of the templates.

The flexible unitary seat shell of the present invention can be made of any thermoplastic material. Conveniently for the manufacturing operation, it is moreover an advantage to employ a high density polyethylene material for the seat shell.

Conveniently, the fabrication of the present invention can be carried out by using any forming method. For the manufacturing operation, it is moreover an advantage to employ a thermoforming method. It is particularly preferred to employ a vacuum thermoforming method and machine.

The permissible thermoforming molding temperature range is a function of the type of plastic material being used for the shell. The molding temperature should be above the set temperature of the plastic material being used and below the melting temperature of the plastic material. In an especially preferred embodiment, where high density polyethylene is used as the plastic material for the shell, the molding temperature is in the range of from approximately 300° F. to approximately 360° F.

The time required to raise the temperature of the plastic material to molding temperature is similarly a function of the type of plastic material being used for the shell. In an especially preferred embodiment, where high density polyethylene is used as the plastic material for the shell, the time required to raise the plastic material to the molding temperature is approximately 3 minutes.

The working time of the material is a function of the set temperature of the material and the forming temperature of the material. The working time of the material is also a function of the rate of cooling.

The demolding temperature range is similarly a function- of the type of plastic material being used for the shell. The demolding temperature should be below the set temperature of the plastic material being used. In an especially preferred embodiment, where high density polyethylene is used as the plastic material for the shell, the demolding temperature is approximately 180° F.

The amount of time required to cool the plastic material to the demolding temperature is a function of the type of plastic material being used and the integrated heat capacity of the mold. In an especially preferred embodiment, where high density polyethylene is used as the plastic material for the shell, the amount of time required to reach the demolding temperature is approximately 4 minutes which can advantageously be the time used to heat a subsequent blank at another station of the vacuum thermoforming machine.

The type of heat source used to thermoform the shell can be any appropriate heat source such as, for example, radiant, gas flame or resistive element. In a particularly preferred embodiment, cloth face infrared panel heaters are used to heat the material.

The temperature of the mold itself, as distinct from the material is below the set temperature of the material. The temperature of the mold itself, as distinct from the material, is maintained within the range of from approximately 150° F. to approximately 170° F.

The temperature of cooling source depends on the type of cooling source. The cooling source is advantageously a chiller, fans, ambient temperature air cooling, or any combination thereof. A particularly preferred embodiment uses ambient temperature air together with a fan located on the top side of the plastic material above the mold. Further, a particularly preferred embodiment used a mold that has internal cooling through a chiller.

The foregoing descriptions of preferred embodiments are provided by way of illustration. Practice of the present invention is not limited thereto and variations therefrom will be readily apparent to those of ordinary skill in the art without deviating from the spirit and scope of the underlying inventive concept. For example, the versatility of the seat shell could be enhanced by providing the assembled seat with a variable geometry seat frame. In addition, although high density polyethylene is preferred for thermoforming the seat shell, any other suitable plastic material could be used in its place. Finally, the individual components need not be constructed of the disclosed materials or be formed in the disclosed shapes, but-could be provided in virtually any configuration which employs a flexible section so as to provide a flexible unitary seat shell.

Although the best mode contemplated by the inventor(s) of carrying out the invention is disclosed above, many additions and changes to the invention could be made without departing from the spirit and scope of the underlying inventive concept. For example, numerous changes in the details of the pans of the flexible unitary seat shell and the forming machinery, the arrangement of the pans and the construction of the combinations will be readily apparent to one of ordinary skill in the art without departing from the spirit and scope of the underlying inventive concept.

Moreover, while there are shown and described herein certain specific combinations embodying the invention for the purpose of clarity of understanding, the specific combinations are to be considered as illustrative in character, it being understood that only preferred embodiments have been shown and described. It will be manifest to those of ordinary skill in the art that certain changes, various modifications and rearrangements of the parts may be made without departing from the spirit and scope of the underlying inventive concept and that the same is not limited to the particular forms herein shown and described except insofar as indicated by the scope of the appended claims.

The entirety of everything cited above or below is expressly incorporated herein by reference.

REFERENCES

1. Throne, James L., Thermoforming, Hanser Publisher, New York (1987).
2. Society of Plastic Industry, Guide to Extruded Plastic Sheets Products, (1988).

What is claimed is:

1. A flexible unitary seat shell comprising: a base section defining a base section plane, said base section including two frame sockets for engaging, along axes that are substantially parallel to said base section plane, projections on a seat frame, each of said two frame sockets protruding from a back of said base section and including an encircling aperture that defines a plane that is nonparallel to said base section plane;

a back section in angular relationship to said base section; and an intermediate section connecting said base section to said back section, said intermediate section forming a hinge between said base section and said back section to permit changes in the angular relationship between said base section and said back section.

2. The flexible unitary seat shell of claim 1, wherein said intermediate section includes an accordion pleated section.

3. The flexible unitary seat shell of claim 1, wherein said intermediate section includes high density polyethylene.

4. The flexible unitary seat shell of claim 1, wherein said intermediate section includes a first side having a seat belt bolt hole and a second side having a seat belt bolt hole.

5. The flexible unitary seat shell of claim 1, wherein said back section includes a snap-fit protrusion.

6. The flexible unitary seat shell of claim 1, wherein said back section includes frame slots.

7. A flexible unitary seat shell comprising:

a base section defining a base section plane, said base section including two frame sockets, each of said two frame sockets protruding from a back of said base section and including an encircling aperture that defines a plane that is nonparallel to said base section plane;

a back section in angular relationship to said base section; and an intermediate section connecting said base section to said back section, said intermediate section forming a hinge between said base section and said back section to permit changes in the angular relationship between said base section and said back section.

8. The flexible unitary seat shell of claim 7, wherein said intermediate section includes an accordion pleated section.

9. The flexible unitary seat shell of claim 7, wherein said intermediate section includes high density polyethylene.

10. The flexible unitary seat shell of claim 7, wherein said intermediate section includes a first side having a seat belt bolt hole and a second side having a seat belt bolt hole.

11. The flexible unitary seat shell of claim 7, wherein said back section includes a snap-fit protrusion.

12. The flexible unitary seat shell of claim 7, wherein said back section includes frame slots.

13. A flexible unitary seat shell comprising:

a base section defining a base section plane, said base section including a plurality of means for engaging, along axes that are substantially parallel to said base section plane, projections on a seat frame, each of said plurality of means protruding from a back of said base section and including an encircling aperture that defines a plane that is nonparallel to said base section plane;

a back section in angular relationship to said base section; and an intermediate section connecting said base section to said back section, said intermediate section forming a hinge between said base section and said back section to permit changes in the angular relationship between said base section and said back section.

14. The flexible unitary seat shell of claim 13, wherein said intermediate section includes an accordion pleated section.

15. The flexible unitary seat shell of claim 13, wherein said intermediate section includes high density polyethylene.

16. The flexible unitary seat shell of claim 13, wherein said intermediate section includes a first side having a seat belt bolt hole and a second side having a seat belt bolt hole.

17. The flexible unitary seat shell of claim 13, wherein said back section includes a snap-fit protrusion.

18. The flexible unitary seat shell of claim 13, wherein said back section includes frame slots.

* * * * *